US005773793A

United States Patent [19]

Matsuo

[11] Patent Number: 5,773,793

[45] Date of Patent: Jun. 30, 1998

[54] IMAGE FIXING ROLLER AND IMAGE FIXING APPARATUS CONTAINING THE SAME

[75] Inventor: Minoru Matsuo, Sagamihara, Japan

[73] Assignee: Ricoh Company, Ltd., Tokyo, Japan

[21] Appl. No.: 645,703

[22] Filed: May 14, 1996

[30] Foreign Application Priority Data

May 18, 1995 [JP] Japan ..... 7-144127
Feb. 27, 1996 [JP] Japan ..... 8-065504

[51] Int. Cl.[6] ..... G03G 15/20

[52] U.S. Cl. ..... 219/216; 399/333; 219/469

[58] Field of Search ..... 219/216, 469; 399/333; 492/46; 432/60, 228

[56] References Cited

U.S. PATENT DOCUMENTS 4,521,095 6/1985 Mayer ..... 219/216

*Primary Examiner*—Teresa J. Walberg
*Assistant Examiner*—J. Pelhem
*Attorney, Agent, or Firm*—Oblon, Spivak, McClelland, Maier & Neustadt, P.C.

[57] ABSTRACT

The present invention relates to an image fixing apparatus for use in an electrophotographic copying machine, more particularly to an image fixing apparatus for thermally fixing toner images on a transfer sheet, and to an image fixing roller for use in the image fixing apparatus.

11 Claims, No Drawings

IMAGE FIXING ROLLER AND IMAGE FIXING APPARATUS CONTAINING THE SAME

BACKGROUND OF THE INVENTION

1. Field of the Invention

The present invention relates to an image fixing apparatus for use in an electrophotographic copying machine, more particularly to an image fixing apparatus comprising an exothermic phase transition layer comprising an exothermic phase transition material and a protective layer provided on an exterior of said exthermic phase transition layer, wherein at least one of said exothermic phase transition material and said protective layer further comprises a thermally conductive material, for thermally fixing toner images on a transfer sheet, and to an image fixing roller for use in the image fixing apparatus.

2. Discussion of the Background

In a conventional electrophotographic copying machine provided with a laser printer, a rotatable photoconductor drum is provided, and copies are typically made via the following steps: a photoconductive portion of a photoconductive drum is uniformly charged by a charging unit, and information is recorded in the form of latent electrostatic images. The images are developed with toner to give toner images, by a development unit in the electrophotographic copying machine. The developed toner images are transferred to a recording sheet, which is then passed through an image fixing apparatus, in which the toner images are thermally fixed to the recording sheet.

In the above-mentioned conventional image fixing apparatus, an image fixing roller is typically employed, which is composed of a hollow core cylinder made of, for instance, aluminum, and a toner-releasing layer which is made of, for instance, a fluoroplastic, provided on the outer peripheral surface of the hollow core cylinder.

In the image fixing roller, a heater such as a halogen lamp is provided in a vacant portion within the hollow core cylinder along the cylinder's axis of revolution, whereby the image fixing roller is heated from the inside by radiant heat.

In parallel with the conventional image fixing roller, there is provided a pressuring roller which comes into pressure contact with the peripheral surface of the image fixing roller.

The toner image-bearing recording sheet is transported so as to pass through the contact portion between the two rollers, where the toner images transferred to the recording sheet are softened by the heat from the image fixing roller and fixed to the recording sheet held between the two rollers, with the application of pressure thereto by the pressure application roller.

In such an image fixing apparatus, however, a relatively long warm-up time is required, after the power supply is turned on, to reach the necessary threshold image fixing temperature on the outer peripheral surface of the image fixing roller.

In order to decrease the warm-up time, conventionally, when the main switch of the machine is turned on, electricity is applied to the heater of the image fixing apparatus, thus starting a preheating of the image fixing roller. This method, however, has the shortcoming of consuming a significant amount of energy.

Further, in order to avoid the above problem, there have been proposed the following exemplary methods for decreasing the warm-up time for such an image fixing roller:

A method of providing a resistive heat emitting layer at or near the peripheral surface of an image fixing roller (Japanese Laid Open Patents 55-164860, 56-138766 and 2-285383); a method of blackening the inner wall of a hollow portion of an image fixing roller to increase the absorptive efficiency thereof, thus increasing the heat decalescence efficiency, a method of increasing the surface area of the inner wall of a hollow portion of an image fixing roller by roughening the surface of the inner wall (Japanese Laid Open Patent 4-34483 and 4-134387), a method of constructing an image fixing roller composed of a heat pipe (Japanese Laid-Open Patent 3-139684); a method of heating an image fixing roller by electromagnetic induction (Japanese Utility Model 4-55055); a method of constructing an image fixing roller (Japanese Laid Open Patent 4-186270); and a method of constructing an image fixing roller which includes a cylindrical heater in which a positive thermistor material is used (Japanese Laid Open Patent 4-42185).

In order to make the above-mentioned methods effective in practical use, it is often necessary that the core roller for each of the image fixing rollers have good heat conductivity. However, reduction of the thickness of the core roller for increasing the heat conductivity is limited in view of the mechanical strength required for practical use of the image fixing roller. Therefore, the above-mentioned methods are not always effective.

Furthermore, a large amount of energy must be applied to the heating elements, such as heaters for the image fixing rollers in order to sufficiently decrease the warm-up time for such conventional image fixing rollers.

The inventor of the present invention has found that a fixing roller having an exothermic phase transition layer that emits heat during a transition from an amorphous state to a crystalline state can sufficiently decrease the warm-up time without consuming a large amount of energy.

In the roller, the exothermic phase transition layer comprises an exothermic phase transition material in an amorphous state, which is initially heated by a heating element of the fixing roller, and when the exothermic phase transition material reaches a temperature for crystallizing, a heat of crystallization is released, rapidly increasing the temperature of the exothermic phase transition layer. Therefore, it is possible to decrease warm-up time sufficiently since the surface of the fixing roller rapidly reaches the fixing temperature.

The exothermic phase transition material is returned to an amorphous state by heating the crystallized exothermic phase transition material beyond the melting temperature (Tm) and cooling. The exothermic phase transition layer can be reused by heating the exothermic phase transition material with the heating element.

Heat created by crystallizing an amorphous exothermic phase transition material prevents itself from emitting heat at the congelation point temperature when the temperature of the material goes down. The accumulated internal energy is emitted when the temperature of the material goes up. However, if heat is emitted too rapidly exceeding the rate of thermal conductivity of the amorphous exothermic phase transition material, heat is accumulated and the temperature of the amorphous exothermic phase transition material exceeds the melting point temperature, thereby the amorphous exothermic phase transition material melts (self-melting). That is, the heat of crystallization is used for melting the exothermic phase transition material as latent heat. As a result, heat does not conduct to the surroundings and it is more difficult to raise the temperature of the roller surface rapidly.

SUMMARY OF THE INVENTION

Therefore, one object of the present invention is to provide an image fixing apparatus comprising an image fixing roller, wherein the apparatus is capable of sufficiently reducing the warm-up time for the image fixing roller for practical use.

Another object of the present invention is to provide an image fixing apparatus with a decreased warm-up time, which does not consume a large amount of energy.

Another object of the present invention is to provide an image fixing roller comprising an exothermic phase transition layer with a reduced tendency for self-melting.

These and other objects of the present invention have been satisfied by the discovery of an image fixing apparatus having an image fixing roller for thermally fixing images on an image receiving material at a predetermined image fixing temperature, the image fixing roller comprising a roller member and an exothermic phase transition layer provided on an exterior surface of said roller member, wherein the exothermic phase transition layer comprises:

i) an exothermic phase transition material capable of undergoing a reversible phase transition from an amorphous state to a crystalline state repeatedly and crystallizing at a crystallization temperature; and ii) a protection layer comprising a protective material provided on an exterior of said exothermic phase transition material for sealing the exothermic phase transition layer to the roller member, wherein at least one of said exothermic phase transition material and said protective layer further comprises a thermally conductive material having a thermal conductivity which is higher than a thermal conductivity of said exothermic phase transition material in a crystalline state when in said exothermic phase transition material and which is higher than a thermal conductivity of said protective material when in said protective layer; and which has a melting point temperature is higher than a fixing temperature.

DESCRIPTION OF THE PREFERRED EMBODIMENTS

An exothermic phase transition layer of the present invention comprises an exothermic phase transition material which is capable of repeatedly undergoing a phase transition from an amorphous state to a crystalline state and emits heat during a transition from an amorphous state to a crystalline state and a protective layer comprising a protective material.

In addition, the exothermic phase transition material does not melt during fixing and the melting point temperature of the exothermic phase transition material is higher than that of the toner fixing temperature. In general, a fixing temperature is 180° to 200° C., therefore it is preferable that the melting point temperature of the exothermic phase transition layer is 200° C. or more. However, depending on of toner material, the fixing temperature varies, so the melting point temperature of 200° C. or more is not restricted to.

Further, the exothermic phase transition material can easily perform the phase transition from an amorphous state to a crystalline state.

Specific non-limiting examples of organic materials with exothermic phase transition properties, taking into account the above-mentioned conditions, are the organic high molecular compounds:

polyethylene, polypropylene, polybutylene, polyvinylidene fluoride, polyoxymethylene, polyoxyethylene, polyoxytetramethylene, polyoxybischloromethyltrimethylene, polyethylene diadipate, polyethylene terephthalate, nylon-6, nylon-7, nylon-8, nylon-9, nylon-10, nylon-11, nylon-12, nylon-6,6, nylon-7,7, nylon-6,10, polybutylene terephthalate, polychlorotrifluoroethylene, polyvinyl alcohol, polyvinyl fluoride, polyvinylidene chloride, polychloroprene, polyethylene oxide, polytrifluorochloroethylene, polyvinyl methyl ether, polyacetal, polyphenylene sulfide, polyether ether ketone, thermoplastic fluoroplastics, aromatic polyester, polyisotactic butadiene and polytetramethylene terephthalate etc.

Specific non-limiting examples of inorganic material with exothermic phase transition properties, taking into consideration the above-mentioned conditions, are the following material:

a) Alloys

Si—S, Si—S—Sb, Si—Sc—As, Si—Se—Sb, Si—Te, Si—Te—P, Si—Te—As, Si—As—Te, Si—Ge—As—Te, Ge—S, Ge—S—In, Ge—S—P, Ge—S—As, Ge—Se, Ge—Se—Te, Ge—Se—P, Ge—Se—As, Ge—Se—Sb, Ge—Te—P, Ge—Te—As, Ge—As, Ge—As—Te, Ge—P—S, Ge—S, Ge—Sb—Se, Ge—As—Se, Ge—P—S, As—S—Se, As—S—Tl, As—S—Sb, As—S—Te, As—S—Br, As—S—I, As—S—Br, As—S—Bi, As—S—Ge, As—S—Se—Te, As—Sb—Tl—S—Se—Te, As—Sb—P—S—Se—Te, As—Se—Cu, As—Se—Ag, As—Se—Au, As—Se—Zn, As—Se—Cd, As—Se—Hg, As—Se—Ga, As—Se—B, As—Se—Tl, As—Se—P, As—Se—Sb, As—Se—Te, As—Se—I, As—Se—In, As—Se—Sn, As—Se—Pb, As—Se—Ge, As—Se—Bi, As—Te—Tl, As—Te—I, As—Te—Ge, Sb—S and C—S etc.

b) Oxides $P_2O_5$, $B_2O_3$, $As_2O_3$, $SiO_2$, $GeO_2$, $In_2O_3$, $Te_2O_3$, $S_3O_2$, $PbO_2$, $SeO_2$, $K_2B_4O_7MaPO_3$, $Na_2Si_2O_5$ and $PbSiO_3$ etc.

c) Sulfides of

B, Ga, In, Ge, Sn, N, P, As, Sb, Bi, O and Se etc.

d) Selenium compounds of

Ta, Si, Sn, Pb, P, As, Sb, Bi, O, S and Te etc.

e) Tellurium compounds of

Ta, Sn, Pb, Sb, Bi, O, Se, As and Ge etc.

f) Halides $BeF_2AlF_3$, $ZnCl_2$, AgCl, AgBr, AgI and $PbCl_2$ etc.

g) Others

S, Se, Te and Pb etc.

Among the above-mentioned materials, amorphous materials of the periodical table Groups III to VI, having a chalcogen(s) as the main component are also effective as exothermic phase transition materials. For example, selenium, selenium-tellurium alloys, tellurium, germanium alloys, selenium-indium based alloys, tellurium-indium based alloys, selenium-antimony based alloys or tellurium-antimony based alloys is used. Selenium-tellurium alloy or selenium are most preferred.

In the present invention, the exothermic phase transition layer may be prepared by conventional methods known to those of ordinary skill in the art such as by evaporation onto a surface of a metal core such as stainless steel or aluminum, in which a heating element such as a halogen lamp, infrared lamp or Ni—Cr wire (NicKrome wire®) is built in, through an oxidized metal film layer. The fixing roller can comprise a heat pipe or a resistive heat emitting layer.

A protecting layer comprising a protective material may be provided on the external surface of the exothermic phase transition material using conventional methods know to those of ordinary skill in the art such as those used for forming a toner releasing layer on a fixing roller, and the protection layer can also function as both a releasing layer for preventing toner from adhering on the fixing device and a protection layer.

As a protective material of the protecting layer, fluorine based resin such as PFA resin, FEP resin or PTFE, or silicone resin. Fluorine resin based thermally contracting tube is preferable.

For example, the protecting layer can be formed by covering the exothermic phase transition material, formed on a surface of the fixing roller, using a thermally contracting tube, such as PFA resin, which contains a thermally conductive material.

In case of formation of a protecting layer or an exothermic phase transition material which contains a thermally conductive material having a thermal conductivity which is higher than a thermal conductivity of said exothermic phase transition material in a crystalline state when in said exothermic phase transition material and which is higher than a thermal conductivity of said protective material when in said protective layer is mixed in at least one of the layers. The thermally conductive material has a higher melting point temperature than that of the fixing temperature.

Alternatively the protecting layer can be a film, such as PFA resin which comprises a protective material and a thermally conductive material. This film can be provided on the exterior surface of an exothermic phase transition material by evaporating the thermally conductive material and protective material resin, such as PFA resin, at the same time from one or more evaporation sources using a vacuum deposition method.

On the other hand, the exothermic phase transition layer can be made by adding an evaporation source of a thermally conductive material when forming the exothermic phase transition material by evaporation.

Alternatively, the exothermic phase transition layer can be made by evaporation, by adding a thermally conductive material into an evaporation source for forming the exothermic phase transition layer.

Suitable thermally conductive materials can be selected by measuring the thermal conductivity of the exothermic phase transition material in the crystalline state or the thermal conductivity of a protecting material and selecting a conventional thermally conductive material which has a higher thermal conductivity than that of the exothermic phase transition material or protecting material.

Examples of such thermally conductive materials include metals, such as aluminum, copper, gold, or silver, metal oxides such as aluminum oxide and titanium dioxide ($TiO_2$) titanium oxide (TiO), tellurium, antimony, carbon fine particles or carbon fibers or fibrils. Among these, Al, Au, Ag, carbon fine particles, carbon fibers or fibrils, Al, Au, Ag, carbon fine particles, carbon fibers, tellurium and antimony are preferred.

Depending on the material and property desired, the amount of thermally conductive material added varies and is preferably from 0 to 50 weight percent based on total weight of the layer in which the thermally conductive materials contained.

Preferably an amount of thermally conductive material is added such that the thermal conductivity of the exothermic phase transition layer and/or the protecting layer is greater than a thermal conductivity of an exothermic phase transition layer and/or a protecting layer without a thermally conductive material. Accordingly addition of the thermally conductive material preferably provides a layer with a higher thermally conductivity than when no thermally conductive material is added.

Preferably, the thermal conductivity of the exothermic phase transition layer is such that, under the pre-heating conditions, the exothermic phase transition material does not melt. The thermal conductivity of the exothermic phase transition layer may be increased by adding a thermally conductive material to the exothermic phase transition material and/or the protective layer.

In the present invention, since the exothermic phase transition layer contains a thermally conductive material with a thermal conductivity which is greater than that of the exothermic phase transition material in a crystallized state, it is possible to rapidly conduct the heat to a surface of the fixing roller even if heat is rapidly created from crystallizing of the exothermic phase transition material when the exothermic phase transition material is heated. It is possible to also prevent the exothermic phase transition material from self-melting and to sufficiently shorten the warm-up time of the fixing roller by efficiently using the heat of crystallization of the exothermic phase transition material.

As a conductive material to be mixed with the exothermic phase transition material, Au, Ag, Al, Sb or a mixture thereof are preferred. These materials are useful because they can be co-evaporated. Therefore, it is possible to rapidly conduct heat which is created in the exothermic phase transition layer onto a surface of a fixing roller.

In a fixing roller which uses crystallizing heat of an exothermic phase layer which is made of an exothermic phase transition material of the periodical table Group III to VI which mainly contains a chalcogen(s), heat of the exothermic phase transition layer rapidly increases because the fixing roller is heated by a heating element therein. Heat conducts through the exothermic phase transition layer to a surface of the fixing roller as it flows and then crystallizing heat is emitted and a temperature of the exothermic phase transition layer rises rapidly when a temperature of the exothermic phase transition material in the amorphous state reaches a crystallizing temperature. Therefore, it is possible to shorten the warm-up time sufficiently since a temperature of the surface of the fixing roller rapidly reaches the fixing temperature.

It is preferable that rate of amorphous to crystalline phase transition is great since rising the temperature of the surface of the fixing roller proceeds rapidly and decrease the warm-up time (the time to rise the temperature of the roller to the fixing temperature).

However, if the heat emitting speed is too fast and heat does not conduct well, it causes the exothermic phase transition material to rise the temperature excessively, wherein, self-melting occurs since finally the exothermic phase transition material reaches a melting point temperature and further emitted heat is wasted for latent heat to melt the material, as a result the heat does not come out.

Especially, in the case where the exothermic phase transition material is covered by a protecting layer or a toner releasing layer which comprises, for example, fluorine resin such as PTFE or PFA, and the conductivity of the layer is not good, heat which is released from the exothermic phase material is prevented from reaching the surface of the fixing roller and tends to cause self-melting of the exothermic phase transition material.

However, in the present invention, the protecting or toner releasing layer may contain a thermally conductive material, with a thermal conductivity which is higher than that of the protective material, thereby, heat created in the exothermic phase transition material conducts to the surface of the fixing roller rapidly.

By forming a protection layer on a toner releasing layer using a thermally contracting tube of fluorine based resin such as PFA etc. containing carbon fine particle or carbon fiber, it is possible to conduct heat created in an exothermic phase transition material rapidly to the fixing roller. In the case of using carbon fiber, the heat conductivity is good since the heat conducts through the fiber to the surface of the fixing roller from the exothermic phase transition material.

It is possible to conduct heat created in the exothermic phase transition material onto the surface of the fixing roller rapidly by forming a film containing Te and PFA resin etc. as a protecting layer or a toner releasing layer on a toner releasing layer by co-evaporating fluorine based resin and Te.

And further, there is an advantage that adherence between the exothermic phase transition material and the protecting layer on the toner releasing layer become great if the exothermic phase transition material comprises SeTe.

Description will be given, showing embodiments of the present invention. The present invention is not limited to the embodiments.

EXAMPLE 1

An exothermic phase transition layer with a 0.1 mm thickness was formed on an Al core with a 20 mm diameter and a 0.4 mm thickness by evaporating SeTe containing 20 weight % of Te in density at an evaporating speed 5 μm/minute.

A thermally contracting tube of conductive PFA resin in which 10 weight % of carbon fine particle was dispersed was covered onto the exothermic phase transition layer of the roller, and heated at 280° C., thereby a toner releasing layer with about an about 20 μm thickness was formed.

The conductivity of the exothermic phase transition layer which consist of SeTe containing 20 weight % in density of Te is 4.9 W/mμK and the conductivity of carbon fine particle is 7 W/mμK.

EXAMPLE 2

After an exothermic phase transition layer was formed in the same manner as the embodiment 1, a thermally contracting tube of PFA resin in which 5 weight % of fiber carbon was dispersed was covered onto the exothermic phase tradition layer of the roller and was heated at 260° C., thereby a toner releasing layer with an about 20 μm thickness was formed. The conductivity of fiber carbon is 100 W/mμK.

EXAMPLE 3

After an exothermic phase transition layer was formed in the same manner as the example 1 and 2, a protecting layer in which Te and PFA were dispersed was formed by evaporating Te and PFA from two evaporating sources at the same time.

The conductivity of Te in an axis direction c of the crystal structure in 3 W/mμK.

EXAMPLE 4

An exothermic phase transition layer with a 0.1 mm thickness was formed on an Al core with a 20 mm diameter and a 0.4 mm thickness by vacuum-evaporating SeTeSb alloy containing 5 weight % of Sb and 20 weight % of Te at an evaporating speed 5 μm/minute.

After that, pure PFA tube (made by Asahi glass company; Afron PFA) was covered onto the exothermic phase transition layer of the roller.

The conductivity of pure PFA is 0.25 W/mμK. The conductivity of metal Sb is 24 W/mμK.

COMPARATIVE EXAMPLE 1

After forming an exothermic phase transition layer on a roller in the same manner as the embodiment 1, pure PFA tube (made by Asahi glass company;Afron PFA) was covered on the exothermic phase transition layer, thereby a protecting layer was formed.

The conductivity of pure PFA is 0.25 W/mμK.

COMPARATIVE EXAMPLE 2

A pure PFA tube as well as that of the comparative example 1 was covered on a core without an exothermic phase transition layer.

Those fixing roller were respectively placed in a fixing devices of a Ricoh Facsimile F17, electrical power 500 W was applied to a halogen lamp disposed in the core.

The temperature rising speed of the surface of the fixing rollers were measured respectively.

Electrical power was set so that the temperature of the surfaces of the roller of the comparative example 2 reached to 190° C. from a normal temperature in 30 seconds.

The results were as follows:

| | |
|---|---|
| Example 1 | Rising time 17 |
| Example 2 | Rising time 15 |
| Example 3 | Rising time 17 |
| Example 4 | Rising time 15 |
| Comparative Example 1 | Rising time 22 |
| Comparative Example 2 | Rising time 30 |

It is apparent that the conductivity of the protecting layer is small in the comparative example 1, thereby, heat created in the exothermic phase transition material will not conduct to the surface of the protecting layer and then an amorphous phase of the exothermic phase transition material self-melts.

As a result, the emitting heat energy are used for latent heat of self-melting, it is impossible to rise the temperature of the surface of the fixing roller rapidly.

Contrary to the comparative examples, in the examples 1, 2, 3 and 4 of the present invention, it was possible to rise the temperature of the surface of the roller rapidly without self-melting, since heat created in the exothermic transition layer conduct to the surface of the protecting layer fast.

This application is based on Japanese Patent Applications JP 7-144127 and JP 8-65504, filed with the Japanese Patent Office on May 18, 1995 and Feb. 27, 1996, the entire contents of which are hereby incorporated by reference.

Obviously, additional modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A fixing roller comprising:

1) a core, 2) a heating member, and 3) an exothermic phase transition layer which performs phase transitions repeatedly from an amorphous state to an crystalline state, comprising:

i) an exothermic phase transition material which has a melting point temperature which is higher than that of a toner fixing temperature; and ii) a protection layer comprising a protective material which is provided on an exterior of said exothermic phase transition layer, wherein at least one of said exothermic phase transition material and said protective layer further comprises a thermally conductive material having a thermal conductivity which is higher than a thermal conductivity of said exothermic phase transition material in a crystalline state when in said exothermic phase transition material and which is higher than a thermal conductivity of said protective material when in said protective layer.

2. The fixing roller of claim 1, wherein said protective layer further comprises said thermally conductive material.

3. The fixing roller of claim 1, wherein said protecting layer is made of fluorine based thermally contracting tube.

4. A fixing roller comprising:

1) a core, 2) a heating member, 3) an exothermic phase transition layer comprising an exothermic phase transition material which has a melting point temperature which is higher than that of a toner fixing temperature and which performs phase transitions repeatedly by being heated by said heating member, and a thermally conductive material with a thermal conductivity which is higher than that of said exothermic phase transition material; and 4) a protecting layer which is provided on an exterior surface of said exothermic phase transition layer, comprising a protective material and a thermally conductive material with a thermally conductivity which is higher than that of said protecting material.

5. A fixing device comprising:

A) a fixing roller comprising:

1) a core roller member, 2) an exothermic phase transition layer provided on an exterior surface of said core roller member, wherein said exothermic phase transition layer comprises an exothermic phase transition material which has a melting point temperature which is higher than that of a toner fixing temperature and which emits heat when changing from an amorphous state to a crystalline state and is capable of reversible phase transition from an amorphous state to a crystalline state repeatedly; and 3) a protection layer comprising a protective material which seals said exothermic phase transition layer and side portions of said exothermic phase transition layer to said roller member, wherein at least one of said exothermic phase transition material and said protective layer further comprises a thermally conductive material having a thermal conductivity which is higher than a thermal conductivity of said exothermic phase transition material in a crystalline state when in said exothermic phase transition material and which is higher than a thermal conductivity of said protective material when in said protective layer; and B) a heating member provide inside said fixing roller.

6. The fixing roller of claim 1, wherein said exothermic phase transition material is an amorphous material comprising at least one element of groups IV to VI of the periodic table and which mainly contains chalcogen.

7. The fixing roller of claim 1, wherein said thermally conductive material is in said exothermic phase transition layer and is selected from the group consisting of Au, Ag, Al, Sb and a mixture thereof.

8. The fixing roller of claim 1, wherein said thermally conductive material is in said protecting layer and is carbon fine particle.

9. The fixing roller of claim 2, wherein said thermally conductive material in said protecting layer is carbon fiber.

10. The fixing roller of claim 2, wherein said thermally conductive material in said protecting layer is Te.

11. An image forming apparatus comprising:

A) a fixing device comprising:

1) a fixing roller comprising:

a) a core, b) a heating member, and c) an exothermic phase transition layer which performs phase transitions repeatedly from an amorphous state to a crystalline state, comprising i) an exothermic phase transition material which has a melting point temperature which is higher than that of a toner fixing temperature; and Ii) a protection layer comprising a protective material which is provided on an exterior of said exothermic phase transition layer, wherein at least one of said exothermic phase transition material and said protective layer further comprises a thermally conductive material having a thermal conductivity which is higher than a thermal conductivity of said exothermic phase transition material in a crystalline state when in said exothermic phase transition material and which is higher than a thermal conductivity of said protective material when in said protective layer.

* * * * *